United States Patent [19]

O'Rourke et al.

[11] 4,328,760

[45] May 11, 1982

[54] SKIRT CONSTRUCTION

[75] Inventors: J. Cam O'Rourke; G. Roger Pilkington; Frank G. Bercha, all of Calgary, Canada

[73] Assignee: Dome Petroleum Limited, Calgary, Canada

[21] Appl. No.: 54,998

[22] Filed: Jul. 5, 1979

[51] Int. Cl.[3] ..... B63B 1/34

[52] U.S. Cl. ..... 114/67 A; 114/40; 180/127

[58] Field of Search ..... 114/40–42, 114/67 A; 405/211, 217, 60–65; 180/116–129

[56] References Cited

U.S. PATENT DOCUMENTS

| | | | |
|---|---|---|---|
| 3,249,166 | 5/1966 | Cockerell et al. | 180/123 |
| 3,524,518 | 8/1970 | Favre | 180/127 |
| 3,749,162 | 7/1973 | Anders | 114/40 |
| 3,808,997 | 5/1974 | Bastian, Jr. | 114/40 |
| 3,929,083 | 12/1975 | Blankenship et al. | 114/40 |

FOREIGN PATENT DOCUMENTS

| | | | |
|---|---|---|---|
| 1142133 | 2/1969 | United Kingdom | 180/129 |

*Primary Examiner*—Trygve M. Blix
*Assistant Examiner*—Jesus D. Sotelo
*Attorney, Agent, or Firm*—Lerner, David, Littenberg & Samuel

[57] ABSTRACT

A skirt system is disclosed in combination with a barge floating on a body of water, the barge having a roof extending over the body of water, for providing a substantial ice-free zone around a barge out to at least a hundred feet from the barge. The skirt system includes (a) a first flexible external skirt, the first skirt being provided with a metallic lip extending parallel to the longitudinal axis of the first flexible external skirt and extending below the lower edge thereof, the first flexible external skirt being adapted to extend into the water; (b) a second flexible internal skirt adjacent the first skirt and spaced from and substantially parallel to the first skirt, the second skirt being slightly shorter than the first skirt whereby the second skirt is adapted to be spaced from the first external skirt when the first external skirt extends into the body of water; and (c) a hot air conduit defined by a compartment formed by the space between the parallel first skirt and (d) a mass of hot air filling the compartment thereby providing an enclosed heated area between the roof and the body of water, the skirt simultaneously providing an air/water seal between the mass of hot air and the water and the second skirt. The combination of the skirt with the above-described system provides a seal between the water/ice interface which will substantially prevent cold air from going under the roof, and yet is sufficient to allow some ice encroachment within the ice free zone around the barge which encroached ice soon is melted to maintain the ice free zone, so that no substantial forces are put on the barge.

7 Claims, 4 Drawing Figures

SKIRT CONSTRUCTION

BACKGROUND OF THE INVENTION (i) Field of the Invention

This invention relates to improvements in the drilling of oil and gas wells in polar regions. More particularly, it relates to improved techniques for effectuating such drilling in the wintertime in the Arctic Ocean and more especially in the Beaufort Sea area of the Arctic Ocean, although it is feasible for application in other areas where similar conditions exist. More specifically, it relates to method and apparatus for sealing of a water-/air interface around canopy systems for ensuring the provision of an ice-free zone around a drillship to enable such wintertime drilling.

(ii) Description of the Prior Art

At the present time drilling in offshore Arctic regions is carried out in the summertime either by the use of drillships anchored at a drill site where the risk of impingement by ice floes is minimal, or through the use of artificial islands. Summertime drilling is feasible for depths from 60 feet to 200 feet or more. Artificial islands currently being used in the shallow water regions of the Beaufort Sea become excessively expensive in water depths of 40 feet or greater. It appears uneconomical at the present time to build artificial islands for exploratory drilling wells in water depths exceeding 40 feet. It may be economical to drill production wells from artificial platforms in water depths exceeding 40 feet. Moreover, it is presently not feasible to drill exploratory wells from floating ice islands in the regions where ice movement is too great (i.e., more than a few feet).

One of the chief obstacles to overcome in drilling in Arctic regions is the Arctic pack ice. The ice grows to a thickness of approximately 6 feet and is laced with pressure ridges and ice islands which can reach thicknesses of over 100 feet. The pack ice moves at speeds from 0 to 20 or more miles per day with an average movement of approximately 2 miles per day.

If drilling were to take place in waters where there was considerable ice movement, a very solid structure would be required in order to withstand the forces exerted upon it by the ice pack and yet to be able to remain on position in order to drill a well. For exploratory drilling operations, a solid bottom founded structure should be provided which could resist the movement of the ice pack and yet would be mobile enough to be transported from one exploratory drilling site to another.

Drilling with structures on the sea bottom has numerous problems. Firstly, there is the problem of designing hulls which could withstand the ice forces from deep ice keels against these structures. In the second place, subsea systems would have problems of buoyancy, life-support systems, power supply, and access for crews and maintenance.

It would, therefore, be desirable to develop another technique that would allow exploratory drilling during winter months. Such system should also be able to extend operational capability into the shorefast ice. This technique has the potential for drilling wells more economically than any other method in the shorefast ice regions. Using this technique, the rate of exploration in the Beaufort Sea would be increased by a factor of from two to four times. This technology of using drillships in shorefast ice could be applied to other regions of the Canadian Arctic. The techniques used for drilling in shorefast ice are a logical step toward developing year-round drilling systems in pack ice regions.

The development of such technology is important since the risks to the environment of a drilling system in the shorefast ice are relatively low. One advantage of operating in shorefast ice is that the ice moves very little throughout the winter. Any oil spilled underneath the ice would be confined to a very small area where it could be removed from the environment.

Such a drill system requires an essentially ice-free zone around the ship so that the ice, should it move by up to 30 feet or more, will not bear against the second drillship. A canopy with a warm air system is proposed to provide this substantially ice-free zone.

The initial problem which the present invention proposes to overcome is to assure the sealing of the air/water interface around the canopy system, by a skirt that wil substantially prevent cold air from going under the canopy but not put any substantial forces on the vessel if the ice moves.

One system for providing a substantially ice-free zone around a drillship is disclosed and claimed in copending United States application Ser. No. 54,997 filed on July 5, 1979 (the relevant contents of which are incorporated herein by reference) directed to a method and warm air canopy providing a substantially ice-free zone around a vessel. The method comprises: (a) creating a finite substantially enclosed zone completely around the periphery of the vessel above the waterline, such zone including a peripheral zone approaching the waterline; (b) continuously circulating warm air within the finite substantially enclosed zone; and (c) continuously injecting warm air into such peripheral zone to provide a substantially ice-free peripheral zone.

The warm air canopy referred to above comprises in combination with the vessel: (a) a plurality of floating modules disposed around, and connected at one end to, the vessel; (b) a continuous, downwardly depending skirt extending completely around the outer periphery of the plurality of floating modules; and (c) an air/water heat exchanger in a selected plurality of the floating modules.

A problem which has arisen with the above two systems is that of ensuring a seal around the canopy system which would substantially prevent cold air from going under the canopy but which would not put any substantial forces on the vessel if the ice moves.

SUMMARY OF THE INVENTION (i) Aims of the Invention

Accordingly, it is an object of this invention to provide a novel skirt system for use with an apparatus for providing a substantially ice-free zone around a drillship out to at least 100 feet from such drillship.

A further object of this invention is to provide such a skirt system which substantially seals the peripheral zone around a drillship while permitting ice movement beneath it.

Another object of this invention is to provide such a skirt system which can be suspended into water, where there are warm water/ice zones, and where freezing on the cold side will be substantially prevented.

(ii) Statement of Invention

In accordance with this invention a barge is provided which is floating on a body of water and which has a roof which extends over that body of water. The barge includes skirt means depending from the roof and comprising (a) a first flexible external skirt provided with a metallic lip extending parallel to the longitudinal axis of the first flexible external skirt, and defining the lower edge thereof, the first flexible external skirt extending into the body of water when the barge is floating on that body of water; (b) a second flexible internal skirt adjacent to the first flexible external skirt and spaced therefrom and substantially parallel thereto, the second flexible internal skirt being shorter than the first flexible external skirt whereby the second flexible internal skirt is spaced from the body of water when the first flexible external skirt extends into the body of water when the barge is floating on that body of water; (c) a hot air conduit defined by a compartment formed by the space between the parallel first flexible external skirt and the second flexible internal skirt; and (d) a mass of hot air filling the compartment, thereby providing an enclosed heated area between the roof and the body of water when the barge is floating on that body of water, the outer skirt sealing the enclosed heated area to thereby prevent the escape of the mass of hot air into the body of water, and the skirt means simultaneously providing an air/water seal between the mass of hot air and the water.

(iii) Other Features of the Invention

By one feature of this invention, the roof comprises a cantilevered extension of a floating barge, provided with a hot air passage duct leading to the air conduit.

By another feature of this invention, the roof comprises a downwardly and outwardly extending cantilevered canopy secured to a barge, the canopy including a hot air passage duct leading to the air conduit.

By yet another feature of this invention, the internal and external skirts are formed of rubber coated synthetic fabric.

By still another feature of this invention, the internal and external skirts are formed, for example, of 60 oz. natural rubber/nylon fabric, or its equivalent.

By another feature of this invention, the metallic lip comprises a reinforced steel plate.

By yet another feature of the invention the barge includes (e) a source of hot air connected to said hot air conduit and (f) fan means for circulating the hot air through the hot air conduit and back to the source of hot air.

BRIEF DESCRIPTION OF THE DRAWINGS

In the accompanying drawings.

Figure 1:
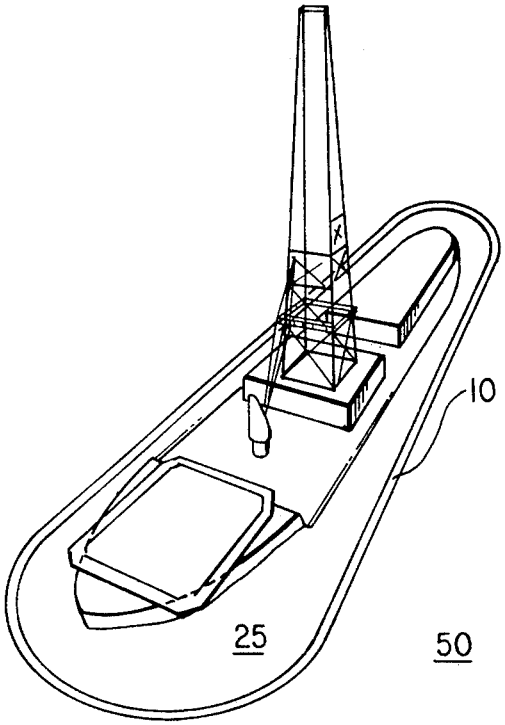
FIG. 1 is a perspective view of one embodiment of a drillship embodying a canopy and the novel skirt system of this invention.
Figure 2:
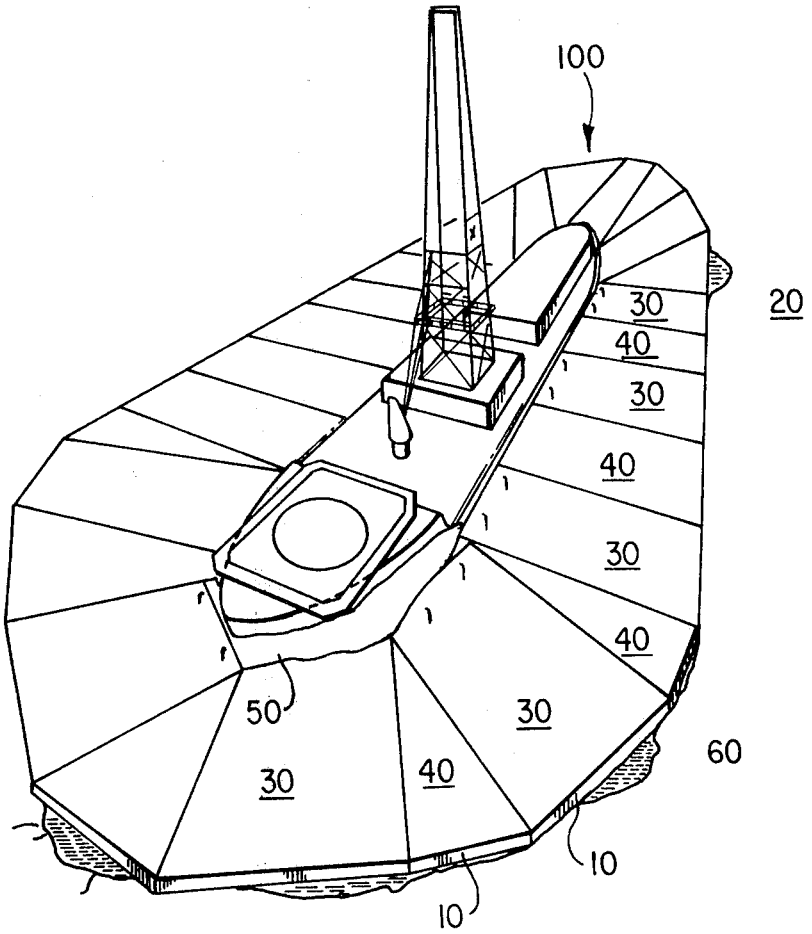
FIG. 2 is a perspective of another embodiment of a drillship employing the novel skirt system of the present invention.

DETAILED DESCRIPTION OF PREFERRED EMBODIMENTS (i) Description of FIGS. 1 and 2

Referring now to FIGS. 1 and 2, a drillship 100 is shown, the drillship being generally of the type used in offshore drilling operations and particularly in Arctic zones. When operating in this environment, particularly in the wintertime, there is a severe hazard associated with the effect of ice encroaching on the drillship itself.

Means have been proposed for operating a drillship in such Arctic areas in the wintertime by providing an ice control zone around the drillship. Such ice control zone should be used in conjunction with a substantially ice-free zone close to the drillship. In order to set up and maintain such substantially ice-free zone around the drillship, the canopy shown in U.S. patent application Ser. No. 54,997 filed July 5, 1979 may be used. Preferably such systems for providing such substantially ice-free zones include a skirt system of this invention.

As seen in FIG. 1, the canopy system includes depending cantilevered canopies 25, forming an extension around the periphery of the drillship 100. Around the rim of canopies 25 is a peripheral flexible downwardly depending skirt 10, which extends downwardly from the outer edge of the canopy 25 to the ice 50.

(ii) Description of FIG. 2

As seen in FIG. 2, the canopy system includes floating modules 30 and roof modules 40, as well as membrane 50 which covers the nonlinear areas in close proximity with the drillship 100 and within the periphery of the canopy system not covered by floating modules 30 and roof modules 40. Floating modules 30 and roof modules 40 are provided with flexible downwardly depending skirts 10, which extend downwardly from the outer edge of floating module 30 and roof module 40 to slightly below the water surface 60.

Figure 3:
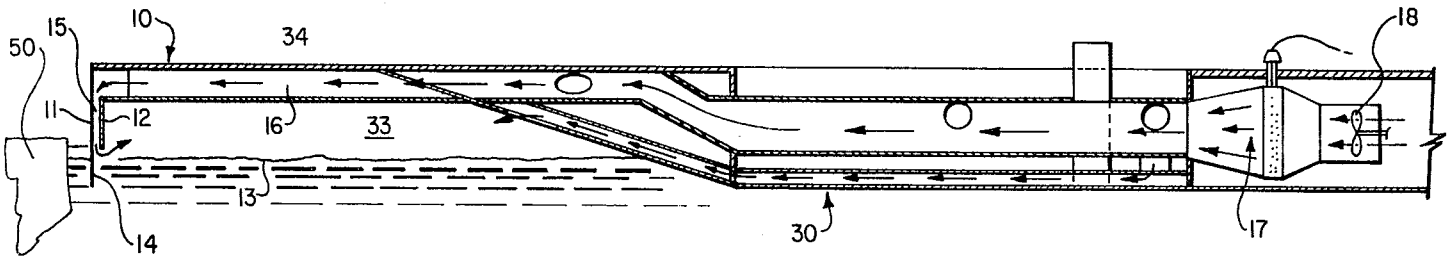
FIG. 3 is a side view of an embodiment of skirt system of the present invention.

The skirt system which is preferably employed about the perimeter of the ice-free zone around the ship and which depends from the floating or cantilevered canopies is shown in detail in FIG. 3.

Figure 4:
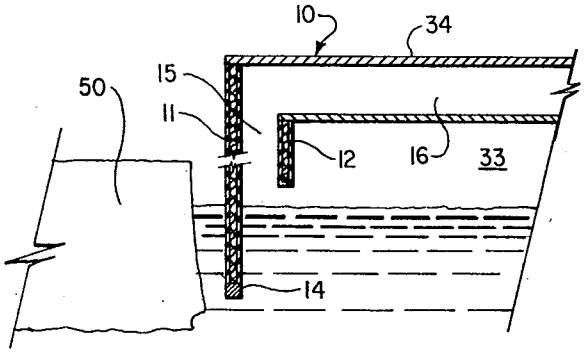
FIG. 4 is an enlarged side view of the skirt of FIG. 3.

(iii) Description of FIGS. 3 and 4

The skirt system 10 comprises a double flexible skirt which is provided constituted by an outside skirt portion 11 and an inside skirt portion 12. The combination of outside skirt portion 11 and inside skirt portion 12 are suspended in the warm water/ice zone which has been created by the use of the hot air compartments at the interface to the outside cold air. Outside skirt portion 11 is of a length sufficient to be suspended below the water surface 13 and is slightly longer than inside skirt portion 12.

Out side skirt portion 11 includes a thicker steel lip 14 on the outside skirt portion 11 at the water surface to hold the lower edge of the skirt below the water surface. Such lip is preferably provided with an ice phobic coating (known to those skilled in the art) intended to prevent ice formation on the cold side of the skirt. The common length portions of the outside skirt 11 and inside skirt 12 are made of suitable fabric, e.g., a rubber coated synthetic fiber fabric, for example, a 60 oz. natural rubber/nylon fabric or its equivalent. The passage 15 between the outside skirt 11 and the inside skirt 12 is connected via appropriate ducts 16 to a source 17 of hot air on the barge 30. Means, e.g. fan 18, are provided for circulating air within the passage 15. Since outside skirt portion 11 is slightly longer than inside skirt portion 12 and since it descends below the surface 13 of the water, the hot air which is pumped through the passage 15 is thereby permitted to return to the area 33 below cantilevered portion 34 of the floating modules 30.

CONCLUSION

In this manner, i.e., by maintaining a heated insulating wall or canopy above the peripheral zones of the drillship, e.g., by the floating modules and roof modules, and by providing a depending skirt of a flexible material, sealing the peripheral edges of the heated canopy, the present invention provides the means for substantially preventing ice formations from encroaching on the drillship. At the same time, it permits ice, which is floating next to the ice-free zone, to pass underneath the flexible skirt, (there to be melted) to maintain the ice-free zone, thereby not substantially damaging the barge structure.

Thus, it is seen that from the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

We claim:

1. A barge floating on a body of water and having a roof which extends over said body of water, said barge including skirt means depending from said roof, said skirt means comprising:

(a) a first flexible external skirt, said first flexible external skirt being provided with a metallic lip extending parallel to the longitudinal axis of said first flexible external skirt, and defining the lower edge thereof, said first flexible external skirt extending into said body of water, when said barge is floating on said body of water;

(b) a second flexible internal skirt adjacent to said first flexible external skirt, and spaced from and substantially parallel to said first flexible external skirt, said second flexible internal skirt being shorter than said first flexible external skirt, whereby said second flexible internal skirt is spaced from said body of water when said first flexible external skirt extends into said body of water and when said barge is floating on said body of water;

(c) a hot air conduit defined by a compartment formed by the space between the first flexible external skirt and said second flexible internal skirt; and (d) A mass of hot air filling said compartment, thereby providing an enclosed heated area between said roof and said body of water when said barge is floating on said body of water, said external skirt sealing said enclosed heated area, thereby preventing the escape of said mass of hot air into said body of water.

2. The barge of claim 1 including a hot air passage duct leading to said compartment.

3. The barge of claim 1 wherein said roof comprises a downwardly and outwardly extending cantilevered canopy secured to said barge, said canopy including a hot air passage duct leading to said compartment.

4. The barge of claim 1 wherein said internal and external skirts are formed of rubber coated synthetic fabric.

5. The barge of claim 1 wherein said internal and external skirts are formed of 60 oz. natural rubber/nylon fabric.

6. The barge of claim 1 wherein said metallic lip comprises a reinforced steel plate.

7. The barge of claim 2 including a source of hot air connected to said hot air passage duct, and fan means for circulating said hot air through said hot air passage duct and back to said source of hot air.

* * * * *